United States Patent [19]

Laxo

[11] 4,014,280

[45] Mar. 29, 1977

[54] ATTITUDE CONTROL SYSTEM FOR SEAGOING VEHICLES

[75] Inventor: Darryl E. Laxo, Novato, Calif.

[73] Assignee: The United States of America as represented by the Secretary of the Navy, Washington, D.C.

[22] Filed: Jan. 2, 1976

[21] Appl. No.: 646,135

[52] U.S. Cl. ..... 114/124; 114/16 E; 244/93

[51] Int. Cl.[2] ..... B63B 39/02

[58] Field of Search ..... 114/16 E, 124, 125, 114/206 R; 244/93, 164; 74/573 F, 573 R

[56] References Cited

UNITED STATES PATENTS

| | | | |
|---|---|---|---|
| 3,295,489 | 1/1967 | Bossa | 114/206 R |
| 3,362,367 | 1/1968 | Rosfelder | 114/124 |
| 3,913,980 | 10/1975 | Cobb | 74/573 F |

FOREIGN PATENTS OR APPLICATIONS

| | | | |
|---|---|---|---|
| 575,164 | 12/1930 | Germany | 114/124 |
| 13,962 | 5/1908 | United Kingdom | 114/124 |
| 101,438 | 9/1916 | United Kingdom | 114/124 |

*Primary Examiner*—Trygve M. Blix
*Assistant Examiner*—Charles E. Frankfort
*Attorney, Agent, or Firm*—R. S. Sciascia; Charles D. B. Curry; James M. Skorich

[57] ABSTRACT

A tube with weights slidably located inside and apparatus to remotely control their position and thereby change the vehicle's center of gravity. The tube is rigidly attached to the vehicle with its centerline running fore and aft if trim is to be controlled or running athwartships if the system is to be used to control list.

3 Claims, 3 Drawing Figures

ATTITUDE CONTROL SYSTEM FOR SEAGOING VEHICLES

BACKGROUND OF THE INVENTION

1. Field of the Invention

This invention relates to seagoing vehicles, and more particularly to means for controlling their attitude in the water.

2. Description of the Prior art

Previously, attitude control, especially with respect to submersible vehicles, was accomplished by systems involving the pumping of liquid mercury from one container to another; ballast tanks taking on sea water as ballast and injecting compressed air into the tanks to force out and displace the appropriate amount of such sea water; and the shifting of solid weights by complex mechanical means.

The prior techniques has disadvantages in that mercury is a lethal material and its use on the open seas poses a serious ecological hazard. Water ballast systems are complex, are not precise, and take up a considerable amount of inboard space. Shifting weight systems tend to be complex. When installed aboard the vehicle, such systems take up a significant amount of the limited available space, whereas externally mounted systems present maintenance problems and are susceptible to damage.

The present invention overcomes these disadvantages by providing an ecologically safe, compact, and structurally simple attitude control system for a seagoing vehicle.

SUMMARY OF THE INVENTION

Briefly, the present invention is a system to control the attitude of a seagoing vehicle, whether it is a surface vessel or a submersible vehicle, by means which are ecologically safe, mechanically simple, precise, and, as it takes up a relatively small amount of space, may be conveniently located aboard the vehicle. Such is accomplished by changing the location of solid spheres in a tube which is aligned to run fore and aft or athwartships, depending upon whether trim or list, respectively, is to be controlled, although two systems may be used simultaneously to control both. The transfer of weight effects the center of gravity of the vehicle and thus its attitude.

OBJECTS OF THE INVENTION

An object of the present invention is to provide a means to control the attitude of a seagoing vehicle without the use of mercury.

Another object is to provide a relatively simple, yet effective and reliable means to control the attitude of a seagoing vehicle.

A further object is to provide an inboard means to control the attitude of a seagoing vessel which occupies a relatively small amount of space.

Yet another object is to provide an accurate means to precisely control the attitude of a seagoing vessel.

Still another object is to control the attitude of a seagoing vehicle by the controlled shifting of weights.

Other objects, advantages and novel features of the invention will become apparent from the following detailed description of the invention when considered in conjunction with the accompanying drawings wherein:

DESCRIPTION OF THE PREFERRED EMBODIMENT

Figure 1:
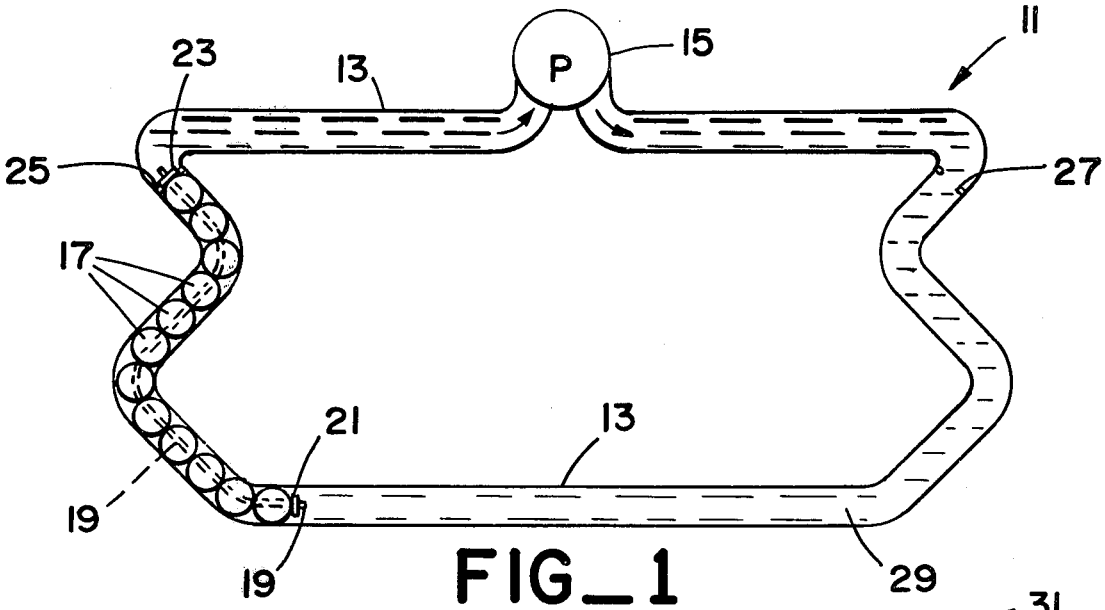
FIG. 1 is a schematic view of an embodiment of the present invention which uses hydraulic means to change the position of the weights in the tube.

Referring to FIG. 1, attitude control system 11 of the present invention includes tube 13, hydraulic pump 15, spherical weights 17, cable 19, cable clamps 21 and 23, stops 25 and 27, and hydraulic fluid 29.

Weights 17 are spheres having a diameter slightly less than the inside diameter of tube 13 and are slidably located within tube 13. Weights 17 abut each other and such positioning is operatively maintained by means of the passage of cable 19 through the center of each of weights 17 and the fixed attachment of clamps 21 and 23 on cable 19 abutting, respectively, the end weights.

Tube 13 communicates with hydraulic pump 15. The volume of tube 13 that is unoccupied by weights 17 is filled with hydraulic fluid 29. Stops 25 and 27 are located within tube 13 and prevent weights 17 from moving beyond them, but allow hydraulic fluid 29 to flow freely through them.

The pumping by pump 15 of hydraulic fluid 29 into the right section of tube 13 creates a pressure differential and thereby forces weights 17 to move to the left until the end weight abuts stop 25. This position is maintained by the continued application of a sufficient hydraulic pressure differential. Such a positioning of weights 17 results in a shift of the center of gravity of the vehicle containing attitude control system 11 and thereby effects a change in its attitude.

Figure 2:
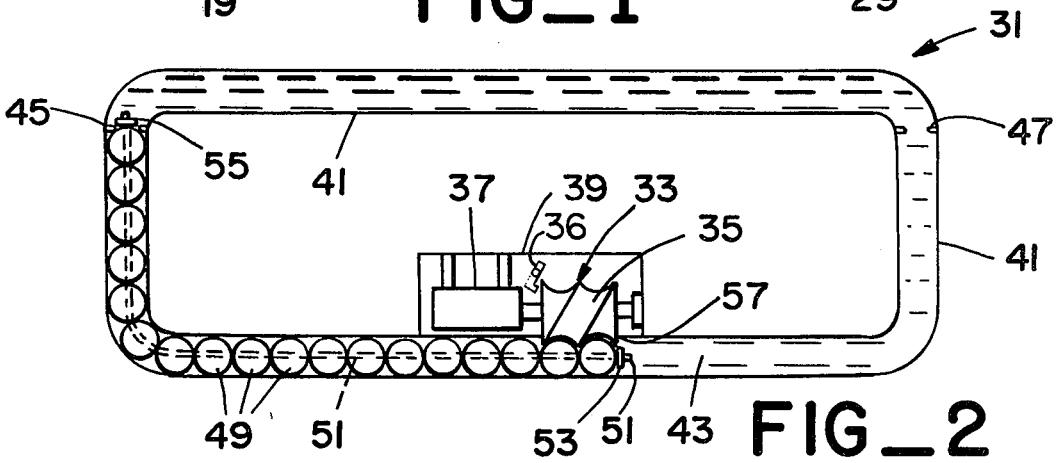
FIG. 2 is a schematic view of an embodiment of the present invention which uses a motor driven screw to change the position of the weights in the tube.

Referring to FIG. 2, attitude control system 31 of the present invention includes driving screw 33 having threads 35, locking device 36 motor 37, housing 39, tube 41, lubricating fluid 43, stops 45 and 47, spherical weights 49, cable 51, cable clamps 53 and 55, and opening 57.

Weights 49 are spheres having a diameter slightly less than the inside diameter of tube 41 and are slidably located within tube 41. Weights 49 abut each other and such positioning is operatively maintained by the passage of cable 51 through the center of each of weights 49 and the fixed attachment of clamps 53 and 55 on cable 51 abutting, respectively, the end weights.

The volume contained by tube 41 that is unoccupied by weights 49 is filled with lubricating fluid 43 to reduce friction and allow weights 49 to slide more freely within tube 41. Stops 45 and 47 are located within tube 41 and prevent weights 49 from traveling beyond them, but allow lubricating fluid 43 to flow freely through to thereby prevent the axial movement of weights 49 from being opposed by otherwise trapped lubricating fluid 43.

Driving screw 33 is inserted into opening 57 in tube 41 to lie partially within tube 41 with its axis of rotation parallel with the axis of symmetry and lying outside of tube 41 in that section of tube 41 breached by opening 57. Screw 33 has threads 35 having a width about equal to the diameter of weights 49, and is threadably engaged with weights 49.

Screw 33 is connected to and rotated by motor 37. Both motor 37 and screw 33 are located within and attached to housing 39.

The clockwise rotation of screw 33 forces weights 49 to the left until the end weight abuts stop 45. Holding screw 33 in a rotatively fixed position by the application of locking device 36 holds weights 49 at any given location. Changing the position of weights 49 by rotating screw 33 results in a shift of the center of gravity of the vehicle containing attitude control system 31 and thereby effects a change in its attitude.

Figure 3:
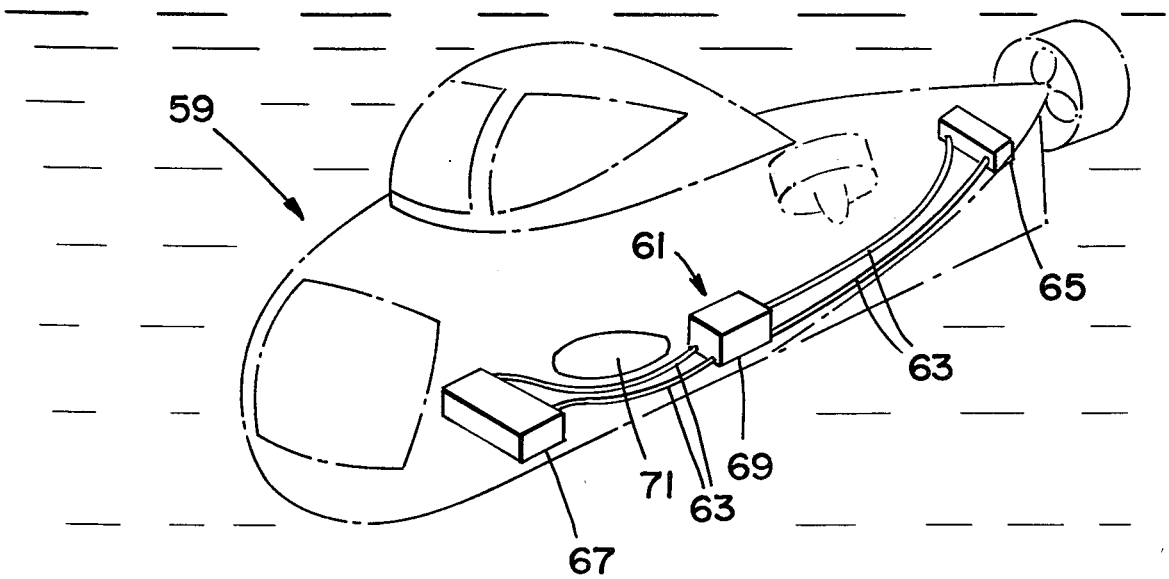
FIG. 3 is a perspective view of the present invention operationally installed to control trim in a submerged submersible vehicle shown in phantom.

FIG. 3 illustrates attitude control system 61 of the present invention operationally installed in submerged submersible vehicle 59 (shown in phantom) to control its trim. Attitude control system 61 is a hydraulic system similar to that embodiment of the present invention previously discussed hereinbefore and shown in FIG. 1 and, therefore, will not again be discussed in detail at this point.

More particularly, system 61 is comprised of tube 63, aft cannister 65, forward cannister 67, and hydraulic mechanism housing 69. Forward cannister 67 and aft cannister 65 each contain coiled segments of tube 63. The two coiled, contained segments of tube 63 each contain a stop (not shown).

Tube 63 contains a chain of spherical weights and hydraulic fluid (both not shown) with the weights being slidable within tube 63. Housing 69 contains hydraulic forcing means, including a hydraulic pump (not shown), communicating with tube 63 and capable of changing the location of the weights in tube 63.

As is shown, tube 63 is shaped to bend around obstacle 71 aboard vehicle 59. It is to be noted that in shaping the tube of the present invention to avoid inboard obstacles, the radius of curvature of any elbow must be sufficiently large to avoid impairing the free axial movement of the weights contained therein.

The operation of the hydraulic forcing means in housing 69 to force the chain of weights into the coils of tube 63 contained in forward cannister 67 shifts the center of gravity of vehicle 59 forward, and thereby causes its nose to dip. Forcing the weights into the coils of tube 63 contained in aft cannister 65 causes the nose of vehicle 59 to rise.

In summary, the attitude control system described herein provides a seagoing vehicle means for attitude control that is precise, mechanically simple, may be installed inboard to thereby facilitate maintenance, takes up relatively little inboard space, and, as it does not use mercury, cannot contaminate the ocean environment in the event of an accident.

What is claimed is:

1. An apparatus to control the center of gravity of an object comprising:

a. a cylindrical tube;
b. a plurality of solid spheres located inside of said tube;
c. said spheres having a diameter slightly less than the inside diameter of said tube in order to allow said spheres to slidably move within said tube along the axis of symmetry of said tube;
d. said spheres being comprised of a first end sphere, a second end sphere, and remaining spheres lying in-between said first end sphere and said second end sphere;
e. a cable;
f. a length of said cable passing through the center of each of said spheres;
g. a first end clamp and a second end clamp;
h. the fixed attachment of said first end clamp to said cable and the fixed attachment of said second end clamp to said cable with each of said spheres abutting another of said spheres and said first end sphere also abutting said first end clamp and said second end sphere also abutting said second end clamp; whereby
i. said spheres are held abutting each other;
j. a driving screw having threads of a width about equal to the diameter of said spheres;
k. a motor, with said motor being rotatably connected to said driving screw;
l. an opening in said tube;
m. said driving screw being partially inserted through said opening into said tube with its axis of rotation lying parallel to the axis of symmetry of the length of said tube in which said opening is located and with said axis of rotation of said driving screw lying outside of said tube;
n. said driving screw being threadably engaged with said spheres; whereby
o. the rotation of said driving screw caused by said motor forces said spheres to move axially within said tube.

2. The invention as claimed in claim 1 including:

a. locking means capable of preventing the rotation of said screw; whereby
b. said spheres may be held in a given location by the application of said locking means to said driving screw.

3. The invention as claimed in claim 2 wherein:

a. said tube forming a closed loop;
b. a lubricating fluid;
c. said lubricating fluid filling the volume of said tube not being occupied by said spheres; whereby
d. said lubricating fluid reduces friction between said spheres and the interior walls of said tube and thereby allows said spheres to slide more freely within said tube.

* * * * *